United States Patent [19]

Jansen et al.

[11] Patent Number: 4,634,647

[45] Date of Patent: Jan. 6, 1987

[54] ELECTROPHOTOGRAPHIC DEVICES CONTAINING COMPENSATED AMORPHOUS SILICON COMPOSITIONS

[75] Inventors: Frank Jansen, Walworth; Joseph Mort, Webster; Michael A. Morgan, Penfield; Steven J. Grammatica, East Rochester, all of N.Y.; John C. Knights, Palo Alto, Calif.

[73] Assignee: Xerox Corporation, Stamford, Conn.

[21] Appl. No.: 695,990

[22] Filed: Jan. 29, 1985

Related U.S. Application Data

[63] Continuation-in-part of Ser. No. 524,801, Aug. 19, 1983.

[51] Int. Cl.[4] ..... G03G 5/085

[52] U.S. Cl. ..... 430/84; 430/95; 430/57

[58] Field of Search ..... 430/57, 65, 66, 84, 430/95

[56] References Cited

U.S. PATENT DOCUMENTS

| | | | |
|---|---|---|---|
| 4,501,807 | 2/1985 | Shirai et al. | 430/84 |
| 4,507,375 | 3/1985 | Hirai et al. | 430/84 |
| 4,525,442 | 6/1985 | Shirai et al. | 430/84 |

*Primary Examiner*—John L. Goodrow
*Attorney, Agent, or Firm*—E. O. Palazzo

[57] ABSTRACT

An electrophotographic photoresponsive device for use in electrophotography comprised of a supporting substrate, and an amorphous silicon composition containing from about 25 parts per million by weight to about 1 weight percent of boron compensated with from about 25 parts per million by weight to about 1 weight percent of phosphorous, nitrogen, or arsenic. Also disclosed is a photoresponsive electrophotographic device comprised of a supporting substrate, an uncompensated amorphous silicon layer and an amorphous silicon composition containing from about 100 parts per million by weight to about 1 weight percent of boron compensated with from about 25 parts per million by weight to about 1 weight percent of phosphorous, wherein the compensation increases from zero percent compensation to one percent compensation, for a distance of from about 0.1 microns to about 5 microns, which distance extends from the uncompensated amorphous silicon layer to the compensated amorphous silicon layer or wherein the photoresponsive device is comprised of a supporting substrate, an uncompensated amorphous silicon composition, a compensated amorphous silicon composition, containing from about 100 parts per million by weight to about 1 weight percent of boron compensated with from about 25 parts per million by weight to about 1 weight percent of phosphorous, wherein the compensation increases from zero percent compensation to one percent compensation, for a distance of from about 0.1 microns to about 5 microns, which distance extends from the uncompensated amorphous silicon layer to the compensated amorphous silicon layer and a top overcoating layer of silicon nitride, silicon carbide, or amorphous carbon.

30 Claims, 5 Drawing Figures

ELECTROPHOTOGRAPHIC DEVICES CONTAINING COMPENSATED AMORPHOUS SILICON COMPOSITIONS

BACKGROUND OF THE INVENTION

This application is a continuation-in part application of U.S. Ser. No. 524,801, filed 8/19/83 entitled Electrophotographic Devices Containing Compensated Amorphous Silicon Compositions. The disclosure of the aforementioned parent application is totally incorporated herein by reference.

The invention is generally directed to the use of amorphous silicon compositions as electrophotographic imaging members, and more specifically, the present invention is directed to photoresponsive imaging devices comprised of compensated amorphous silicon. In one embodiment of the present invention, there are provided layered photoresponsive devices containing compensated amorphous silicon compositions. These devices can be incorporated into an electrophotographic imaging system, particularly xerographic imaging systems, wherein the latent electrostatic images which are formed, can be developed into images of high quality, and excellent resolution.

Electrostatographic imaging systems, particularly xerographic imaging systems are well known, and are extensively described in the prior art. In these systems generally, a photoresponsive or photoconductor material is selected for forming the latent electrostatic image thereon. This photoreceptor is generally comprised of a conductive substrate containing on its surface a layer of photoconductive material, and in many instances, a thin barrier layer is situated between the substrate and the photoconductive layer to prevent charge injection from the substrate, which injection would adversely affect the quality of the resulting image. Examples of known useful photoconductive materials include amorphous selenium, alloys of selenium, such as selenium tellurium, selenium arsenic, and the like. Additionally, there can be selected as the photoresponsive imaging member various organic photoconductive materials, including, for example, complexes of trinitrofluorenone and polyvinylcarbazole. Recently, there has been disclosed layered organic photoresponsive devices containing charge transport layers and photogenerating layers. Examples of charge transport layers include various diamines, while examples of photogenerating layers include trigonal selenium, metal and metal-free phthalocyanines, vanadyl phthalocyanines, and the like. Layered photoresponsive devices are described in U.S. Pat. No. 4,265,990, the disclosure of which is totally incorporated herein by reference.

Many other patents are in existence describing photoresponsive devices including layered devices, containing generating substances, such as U.S. Pat. No. 3,041,167, which discloses an overcoated imaging member containing a conductive substrate, a photoconductive layer, and an overcoating layer of an electrically insulating polymeric material. This member is utilized in an electrophotographic copying method by, for example, initially charging the member with an electrostatic charge of a first polarity, and imagewise exposing to form an electrostatic latent image, which can be subsequently developed to form a visible image. Prior to each succeeding imaging cycle, the imaging member can be charged with an electrostatic charge of a second polarity which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

Also known are amorphous silicon photoconductors, reference U.S. Pat. No. 4,265,991. There is disclosed in this patent an electrophotographic photosensitive member containing a substrate, a barrier layer, and a photoconductive overlayer of amorphous silicon containing 10 to 40 atomic percent of hydrogen and having a thickness of 5 to 80 microns. Additionally, this patent describes several processes for preparing amorphous silicon. In one process, there is prepared an electrophotographic sensitive member which involves heating the member contained in a chamber to a temperature of 50° C. to 350° C., introducing a gas containing a hydrogen atom into the chamber, causing an electrical discharge in the space of the chamber, in which a silicon compound is present, by electric energy to ionize the gas, followed by depositing amorphous silicon on an electrophotographic substrate at a rate of 0.5 to 100 Angstroms per second by utilizing an electric discharge while raising the temperature of the substrate, thereby resulting in an amorphous silicon photoconductive layer of a predetermined thickness. While the amorphous silicon device described in this patent is photosensitive, after a minimum number of imaging cycles, less than about 10, for example, unacceptable low quality images of poor resolution, with many deletions, result. With further cycling, that is, subsequent to 10 imaging cycles and after 100 imaging cycles, the image quality continues to deteriorate often until images are partially deleted. Accordingly, while the amorphous silicon photoresponsive device of the '991 patent is useful, its selection as a commercial device which can be used for a number of imaging cycles is not readily achievable.

While it is not desired to be limited to theory, it is believed that the degradation of the electrophotographic performance of amorphous silicon is caused by the sensitivity of the surface of the silicon device to physical and chemical alterations, including abrasion, scratching, and exposure of amorphous silicon to a corona atomsphere, especially at high humidities. These sensitivities create fundamental limitations for the practical use of devices wherein the exposed surface contains substantially amorphous silicon. While this problem can be minimized by encapsulating the amorphous silicon with a chemically passive, hard overcoating layer of amorphous silicon nitride, amorphous silicon carbide, or amorphous carbon, such devices when incorporated into xerographic imaging systems result in image blurring and very rapid image deletion in a few imaging cycles, typically less than about 10. In these overcoated devices, poor image quality with cycling is caused by an increase in the surface conductivity of the underlying amorphous silicon layer, rather than to abrasion or chemical interactions with the photosensitive surface as occurs with amorphous silicon containing no protective overcoating layer. This conductivity increase is induced by the electric field existing at the surface of the overcoated device, similar to the effect resulting from the field effect in well-known metal-insulator-semiconductor devices. The induced surface conductivity causes a lateral spreading of the photogenerated charges in the electric field fringe fields associated with line or edge images projected on the photoreceptor surface, thus causing undesirable image blurring and image deletion.

The existence of a field effect phenomena in amorphous silicon is well known, as this material functions as an extrinsic amorphous semiconductor, that is, a semiconductor whose conductivity can be substantially modified by impurity doping and by electric fields. In contrast, the conductivities of many other photoreceptor materials, such as those based on chalcogenides, will not be significantly modified by either impurity doping or electric fields. The above disadvantages are substantially eliminated with the photoresponsive device of the present invention containing compensated amorphous silicon compositions. More specifically, the present invention discloses substantially hydrogenated amorphous silicon compositions wherein the increase in lateral conductivity caused, for example, by field effects has been substantially minimized. By compensation, which term is well known in the semiconductor arts, is meant the simultaneous incorporation into amorphous silicon of donor-type components, and acceptor-type components, in appropriate relative concentrations such that the electrical conductivity of the compensated material is substantially unchanged from the uncompensated material. Image deletion, and image blurring, is not observed in photoconductive devices comprised of compensated amorphous silicon compositions.

Thus, while amorphous silicon and the compensated amorphous silicon compositions of the present invention are substantially electrically similar, that is, they are both photosensitive, can be charged to high electric fields, and have good carrier range, they differ significantly in their image capabilities in that after 10 imaging cycles, images formed with amorphous silicon photoconductors begin to deteriorate rapidly as disclosed hereinbefore. There thus continues to be a need for improved photoconductive materials, particularly photoconductive devices containing amorphous silicon which can be repeatedly used in a number of imaging cycles without deterioration therefrom. Additionally, there continues to be a need for improved layered imaging members containing amorphous silicon, especially compensated amorphous silicon which is humidity insensitive, and is not adversely affected by the electrical consequences resulting from scratching and abrasion. Further there continues to be a need for improved photoresponsive devices containing compensated amorphous silicon compositions, which devices can be prepared with a minimum number of processing steps, and wherein the layers are sufficiently adhered to one another to allow the continuous use of such devices in repetitive imaging and printing systems. Moreover, there continues to be a need for photoresponsive devices containing compensated amorphous silicon compositions, wherein the conductivity of such devices is relatively insensitive to externally applied electric fields. Also, there continues to be a need for amorphous silicon materials which can be selected for incorporation into an electrophotographic imaging system, and wherein such materials are not sensitive to humidity and corona ions generated by the charging apparatus, thereby allowing such a material to be useful over a substantial number of imaging cycles without causing a degradation in image quality, and specifically, without resulting in blurring of the images produced. Also, there continues to be a need for compensated amorphous silicon compositions which can be fabricated from relatively impure, and thus relatively inexpensive starting materials, such as silane and other hydride gases.

SUMMARY OF THE INVENTION

It is therefore an object of the present invention to provide photoresponsive imaging devices which overcome the above-noted disadvantages.

Yet another object of the present invention resides in the provision of useful compensated amorphous silicon compositions.

A further specific object of the present invention resides in the provision of improved layered photoresponsive devices containing compensated amorphous silicon compositions.

In a further object of the present invention there are provided photoconductive devices, including single layered devices, containing compensated amorphous silicon compositions, which devices are substantially insensitive to humidity, and to ions generated from a corona charging apparatus, thereby enabling the use of these devices in xerographic imaging systems for obtaining images of high quality and excellent resolution for a number of imaging cycles.

In yet another object of the present invention, there are provided photoresponsive imaging devices containing compensated amorphous silicon compositions, which compositions contain various amounts of phosphorous and boron, or similar n and p type dopants, such as arsenic, or nitrogen.

These and other objects of the present invention are accomplished by the provision of compensated amorphous silicon compositions, and photoresponsive devices containing these compositions. More specifically, in accordance with the present invention, there are provided photoresponsive devices or photoconductor materials comprised of a homogeneous layer of compensated amorphous silicon compositions, and layered photoresponsive devices comprised of uncompensated amorphous silicon as a charge carrier transport layer, situated between a supporting substrate, and a top overcoating layer of the compensated amorphous silicon compositions of the present invention. Additionally, the present invention includes layered photoresponsive imaging devices comprised of compensated amorphous silicon compositions, and overcoating layers of, for example, silicon nitride, silicon carbide, amorphous carbon, and the like.

In one specific embodiment, the present invention is directed to a photoresponsive device comprised in the order stated of (1) a supporting substrate, and (2) compensated amorphous silicon compositions. In a further specific embodiment of the present invention, there are provided photoresponsive devices comprised in the order stated of (1) a supporting substrate, (2) a charge carrier transport layer comprised of uncompensated amorphous silicon, or amorphous silicon, doped with boron or phosphorous, or similar equivalent dopants, and (3) compensated amorphous silicon.

In another important embodiment, the present invention is directed to a photoresponsive device comprised of (1) a supporting substrate, (2) compensated amorphous silicon, and (3) an overcoating layer of silicon nitride, silicon carbide, or amorphous carbon. Furthermore, in accordance with the present invention, there are provided photoresponsive devices comprised of (1) a supporting substrate, (2) a carrier transport layer comprised of uncompensated amorphous silicon, or amorphous silicon doped with boron or phosphorous, (3) compensated amorphous silicon, and (4) a top overcoating layer of silicon nitride, silicon carbide, or amorphous carbon. With regard to the latter photoresponsive devices, the top overcoating layer can be rendered partially conductive as illustrated hereinafter.

The photoresponsive devices of the present invention can be incorporated into various imaging systems, particularly xerographic imaging systems. In these systems, latent electrostatic images are formed on the devices involved, followed by developing the images with known developer compositions, subsequently transferring the image to a suitable substrate, and optionally permanently affixing the image thereto. The photoresponsive imaging members of the present invention when incorporated into these systems are insensitive to humidity conditions and corona ions generated from corona charging devices, enabling the photoresponsive imaging members used to generate acceptable images of high resolution for an extended number of imaging cycles exceeding, in most instances, 100,000 imaging cycles, and approaching over one million imaging cycles. Moreover, the photoconductive imaging members of the present invention can be selected for use in xerographic printing systems.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
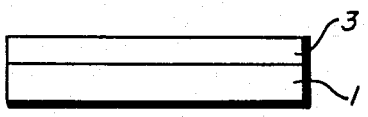
FIG. 1 is a partially schematic cross-sectional view of the photoresponsive device of the present invention.

Illustrated in FIG. 1 is a photoresponsive device of the present invention, comprised of a supporting substrate 1, and compensated amorphous silicon 3.

Figure 2:
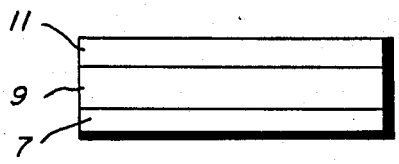
FIG. 2 is a partially schematic cross-sectional view of a further photoresponsive device of the present invention.

Illustrated in FIG. 2 is a photoresponsive device of the present invention comprised of a supporting substrate 7, a charge carrier transport layer 9 comprised of uncompensated amorphous silicon, or uncompensated amorphous silicon doped with boron phosphorous, or similar equivalent materials, and a top overcoating layer 11, which consists of compensated amorphous silicon.

Figure 3:
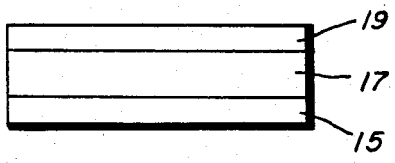
FIG. 3 illustrates another photoresponsive imaging device embodiment of the present invention.
Figure 4:
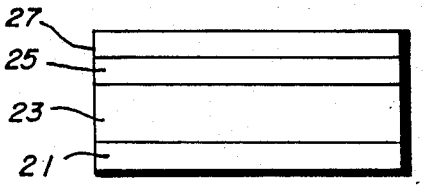
FIG. 4 is a partially schematic cross-sectional view of further photoresponsive devices embraced by the present invention.

Illustrated in FIGS. 3 and 4 are photoresponsive devices of the present invention, a three-layered device being illustrated in FIG. 3, while a four-layered device is illustrated in FIG. 4. In FIG. 3, there is illustrated a supporting substrate 15, a compensated amorphous silicon layer 17, and a top overcoating layer of 19, comprised of silicon nitride, silicon carbide, or amorphous carbon.

In FIG. 4, there is illustrated a supporting substrate 21, a carrier transport layer 23 of uncompensated amorphous silicon, or uncompensated amorphous silicon doped with boron or phosphorous, compensated amorphous silicon layer 25, and a top overcoating layer 27, comprised of silicon nitride, silicon carbide, or amorphous carbon.

Figure 5:
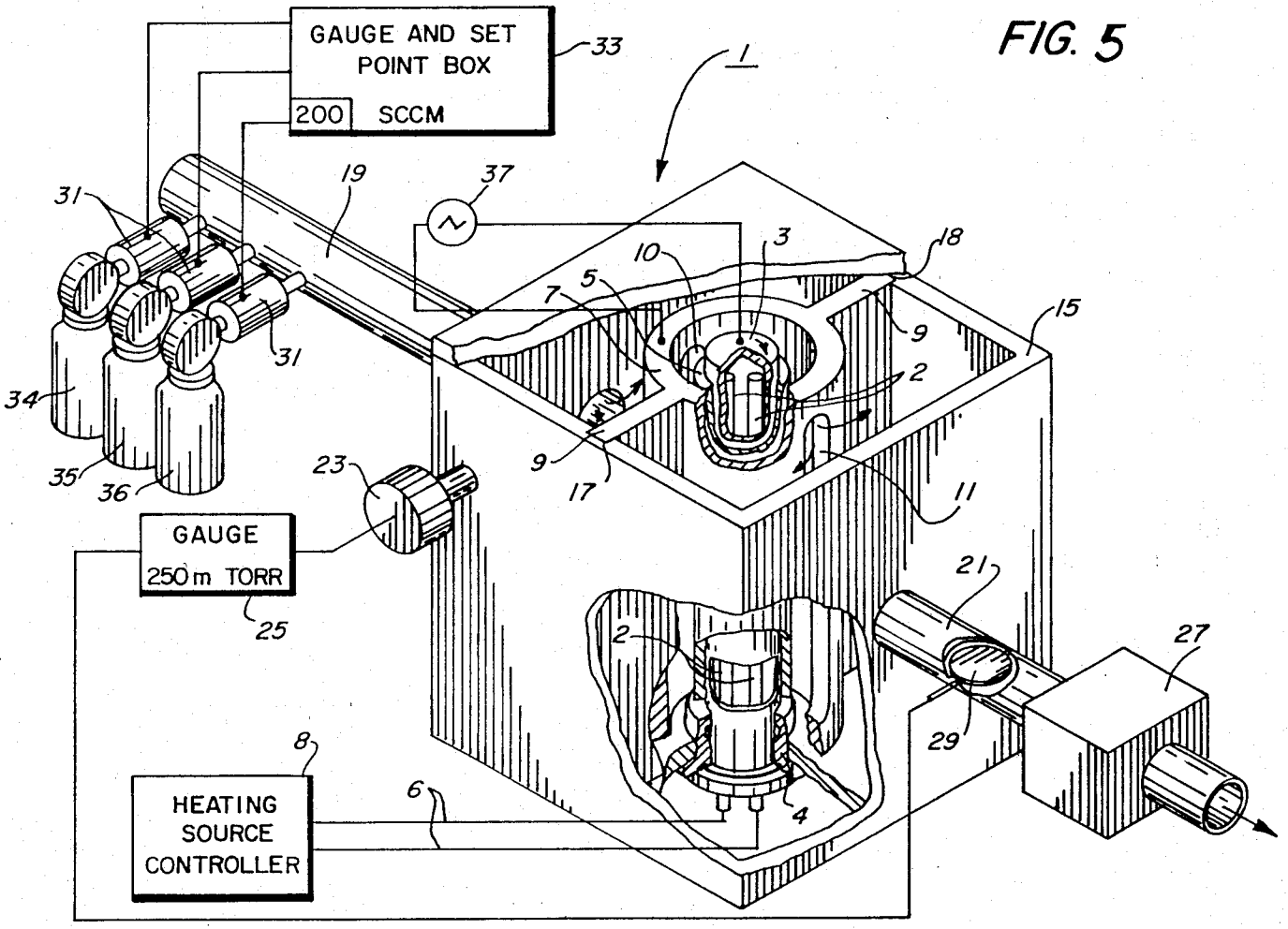
FIG. 5 illustrates an apparatus for preparing compensated amorphous silicon compositions, and related devices.

Illustrated in FIG. 5 is an apparatus which can be used for fabrication of the described devices and compositions. There is thus illustrated in this figure a cylindrical electrode 3 which is secured to an electrically insulated rotating shaft, which contains heating elements 2 with connecting wires 6, connected to heating source controller 8. A cylindrical substrate 5 is secured by end flanges to the cylindrical electrode 3. Furthermore there is illustrated a cylindrical counter electrode 7 which is coaxial with cylindrical electrode 3 and which contains flanges 9 thereon and slits 10 and 11 therein. A vacuum chamber 15, contains as an integral part receptacles 17 and 18 for flanges 9 and in addition has attached a vacuum sensor 23, a gauge 25, a vacuum pump 27 with a throttle value 29. Gas pressure vessels 34, 35, 36 are connected through flow controls 31 to manifold 19 and the vacuum chamber 15. The gas flow controls 31 are electrically controlled and read out from gauge and set point box 33. Also, an electrical source is connected to the cylindrical electrode 3 and the counterelectrode 7.

Although not specifically illustrated in the Figures, there is also included within the scope of the present invention, photoresponsive devices substantially equivalent to the devices as illustrated in FIG. 3, or FIG. 4, with the exception that the top overcoating layer is rendered partially conductive. Thus, the overcoating layers, 19 of FIG. 3, and 27 of FIG. 4, comprised of silicon nitride, or silicon carbide, are rendered conductive by fabricating these layers in such a way that a non-stoichiometric composition $SiN_x$, or $SiC_y$ results, wherein x is a number of from about 1 to about 1.3, and y is a number of from 0.7 to about 1.3. These compositions render the top overcoating layer more electrically conductive than highly insulating stoichiometric compositions. Moreover, there is included in the present invention photoresponsive devices, substantially equivalent to those devices as illustrated in FIGS. 3 and 4, wherein the top overcoating layers 19 and 27 are comprised of silicon nitride, silicon carbide, or amorphous carbon, doped with from about 0.5 percent to about 5 percent of phosphorous or boron, which doping renders the insulating overcoatings partially conductive enabling the further enhancement of image quality.

The supporting substrate for each of the photoresponsive devices illustrated in the figures may be opaque or substantially transparent, and may comprise various suitable materials having the requisite mechanical properties. Thus the substrate can be comprised of numerous substances, providing the objectives of the present invention are achieved. Specific examples of substrates include insulating materials such as inorganic or organic polymeric materials, a layer of an organic or inorganic material having a semiconductive surface layer thereon, such as indium tin oxide, or a conductive material such as, for example, aluminum, chromium, nickel, brass, stainless steel, or the like. The substrate may be flexible or rigid and may have many different configurations, such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer, such as, for example, polycarbonate materials, commercially available as Makrolon. The substrates are preferably comprised of aluminum, stainless steel, or an oxidized nickel composition.

The thickness of the substrate layer depends on many factors including economical considerations, and required mechanical properties. Accordingly, for example, thus this layer which is preferably comprised of aluminum, or a stainless steel sleeve can be of a thickness of from about 0.01 inches to about 0.2 inches, and preferably is of a thickness of from about 0.5 inches to about 0.15 inches. In one particularly preferred embodiment, the supporting substrate is comprised of oxidized nickel, in a thickness of from about 1 mil to about 10 mils.

A very important layer for the photoresponsive devices illustrated, are the compensated amorphous silicon composition layers. Compensation, in accordance with the present invention, refers to the balancing of the opposite effects on the electronic properties of n-type, and p-type dopants, such as phosphorous, or boron, contained in uncompensated amorphous silicon compositions. Specifically therefore in accordance with the present invention by compensation is meant that substantially equal amounts of dopants, such as phosphorous, and boron are included in the amorphous silicon. For example when boron is present in an amount of about 50 parts per million, from about 40 to about 60 parts per million of phosphorous are present. The combined presence of phosphorous, and boron dopants, in uncompensated amorphous silicon substances, counteracts, or compensates the effects of the electronic properties which these dopants would have individually. The compensated amorphous silicon compositions of the present invention are prepared, for example, by introducing simultaneously into a reaction chamber, as more specifically detailed hereinafter, a silane gas, doped with about equal amounts of diborane gas, and phosphine gas, diborane gas and a nitrogen-containing gas, such as nitrogen or ammonia, or alternatively diborante with arsenic. A useful range of compensation for the devices of the present invention is from about 25 parts per million compensation, to 1 percent compensation, or 10,000 parts per million compensation, wherein parts per million refers to the weight concentration of the individual donor dopant atoms, such as boron, or phosphorous, in the amorphous silicon material. The use of compensated amorphous silicon materials allows charging of the resulting photoresponsive devices at high fields, for example up to 50 volts per micron, while simultaneously maintaining excellent transport properties of the charge carriers through the device. Additionally, the devices containing the compensated amorphous silicon of the present invention, including overcoated devices, are desirably humidity insensitive, and remain unaffected by humidity and corona ions generated by corona charging devices. These properties provide photoresponsive devices which can be desirably used for numerous imaging cycles, allowing for the production of high quality non-blurred images, for thousands of imaging cycles. The compensated amorphous silicon compositions described thus provide materials which can be selected for use in a photoconductive imaging device which not only possesses desirable electrical properties and desirable photosensitivity, but also enables the device to be used for a substantial number of imaging cycles without deterioration of the image in contrast to uncompensated known amorphous silicon materials which deteriorate undesirably in about 10 imaging cycles.

It is known that by adding boron alone to amorphous silicon, about 4 to 25 parts per million, the hole transport properties thereof improve, however, the charge acceptance decreases slightly. However, electrons do not migrate through such a doped device and the device cannot be photodischarged negatively. A complimentary situation occurs when incorporating phosphorous alone into amorphous silicon. In contrast, however, the hole transport properties of the device are significantly decreased, and electron transport properties increased, thus this device cannot be positively light discharged. Likewise, the addition of 100 parts per million of boron alone to amorphous silicon renders the resulting device very conductive, allowing it to be charged to only a very low potential, below about 1 volt.

In contrast, photoresponsive devices or photoreceptors comprised of the amorphous compensated silicon materials of the present invention which contain both boron and for example phosphorous even at levels well in excess of 100 parts per million can be charged to high fields of for example of about 50 volts per micron, and have desirable carrier transport properties. While the electrical properties of compensated amorphous silicon are substantially similar to the electrical properties of uncompensated amorphous silicon, these two materials differ significantly in their image capabilities in that with photoresponsive devices containing compensated amorphous silicon degradation of the devices does not result, since the devices involved are not sensitive to humidity and corona ions generated by corona charging apparatuses. The imaging capabilities of compensated amorphous silicon with respect to corotron interaction is also desirably improved for devices containing these compositions, and for overcoated devices thereof, in view of what is believed to be the elimination of the formation of a laterally conductive surface area. Further the use of compensated amorphous silicon, allows the devices of the present invention to be used for a substantial number of increased imaging cycles, as compared to devices containing uncompensated amorphous silicon; and furthermore, with compensated amorphous silicon, image quality is excellent, and image blurring is eliminated, which blurring is present with uncompensated amorphous silicon beginning with less than about 10 imaging cycles.

With reference to FIGS. 1 and 3, the compensated amorphous silicon layers 3 and 17 have a compensation level of from about 25 parts per million to about 1 percent by weight, and preferably are of a compensation level of 100 parts per million. Generally, the thickness of the compensated amorphous silicon layer 3 is from about 5 microns to about 40 microns, and preferably is of a thickness of from about 10 microns to about 20 microns.

As compensating doping materials, there is generally used boron and phosphorous; however, other doping materials can be selected including, for example, combinations of boron with nitrogen, or boron with arsenic. Moreover, the compensated amorphous silicon layer may be alloyed with other materials, such as carbon or germanium, for the purpose of changing the band gap and therefore desirably affecting the dark discharge or photosensitive properties of the resulting xerographic device.

With regard to FIGS. 2 and 4, the amorphous silicon layers 11, or 25, are compensated at a level of from about 25 parts per million to about 1 percent, and preferably are compensated at an amount of from about 0.1 percent to about 1 percent. The thickness of the compensated amorphous silicon layer in these embodiments is from about 0.5 micron to about 5 microns, and preferably the compensated amorphous silicon layer is of a thickness of from about 1 micron to about 2 microns. As compensating doping materials for these embodiments there is generally selected boron and phosphorous; however, mixtures of other compositions can be used as indicated herein, including boron and nitrogen, boron and arsenic, and other similar equivalent materials. Additionally, the compensated layer may be alloyed with materials such as carbon or germanium for the purpose of modifying the band gap and therefore desirably affecting the dark discharging or photosensitive properties of the resulting xerographic device. The charge carrier uncompensated amorphous silicon layers, reference layers 9 and 23, are of a thickness of from about 5 to about 40 microns, and preferably are of a thickness of from about 10 to about 20 microns. This uncompensated layer is generally doped with up to 10 parts per million of boron, or phosphorous. However, this layer can also be undoped or contain higher levels of dopant nonuniformily mixed therein with the high level dopant located near the bottom interface of this layer. Additionally, other substances can be used as dopants for the uncompensated amorphous silicon layer such as arsenic, nitrogen, and the like, and other compositions may be added to the amorphous silicon as alloying materials, including carbon and germanium.

The thicknesses of the top layers, with reference to FIGS. 3 and 4, for example layers 19 and 27, which can be comprised of silicon nitride, silicon carbide or amorphous carbon, is from about 0.1 micron to about 1 microns, and preferably this layer is of a thickness of 0.5 micron. Furthermore, for the purpose of rendering the top overcoating layers more conductive, these can be fabricated layers to consist of a non-stoichiometric amount of a silicon nitride, $SiN_x$ or silicon carbide, $SiC_y$, where x is a number from about 1 to about 1.3 and y is a number between 0.7 and 1.3. Additionally, the top coatings can be rendered more conductive, namely the silicon nitride, silicon carbide or amorphous carbon, by doping these materials with from about 1 weight percent to about 5 weight percent of phosphorous, available from phosphine $PH_3$, or boron, available as diborane gas, $B_2H_6$. Increasing conductivity of the top layers allows for further desirable image enhancement, while the silicon nitride, silicon carbide or amorphous carbon top overcoatings provide devices with additional hardness further protecting the device containing the compensated amorphous silicon from mechanical abrasion, including undesirable scratches.

Increased conductivity for the top layer in the photoresponsive devices of the present invention illustrated in FIGS. 2 and 4 is believed to decrease the electric field over this layer more rapidly between xerographic imaging cycles, thus desirably causing the residual voltage present to be constant. Additionally, such constant residual voltage allows images of high resolution to be obtained for a very large number of imaging cycles.

The photoresponsive devices of the present invention, and the compensated amorphous silicon contained therein are prepared by simultaneously introducing into a reaction chamber, such as that illustrated in FIG. 5, a silane gas, a source of phosphorous, such as phosphine, and a source of boron, such as diborane gas. More specifically, this process involves providing a receptacle containing therein a first substrate electrode means, and a second counterelectrode means, providing a cylindrical surface on the first electrode means, heating the cylindrical surface with heating elements contained in the first electrode means, while causing the first electrode means to axially rotate, introducing simultaneously into the reaction vessel a source of silicon containing gas, such as a silane gas, a phosphorous containing gas, such as phosphine, and a boron containing gas, such as diborane, at a right angle with respect to the cylindrical member, applying a voltage between the first electrode means, causing a current to the second electrode means, whereby the silane gas is decomposed resulting in the deposition of amorphous silicon, containing phosphorous and boron therein, on the cylindrical surface. The gases are introduced into the reaction chamber in appropriate relative amounts to provide the level of compensation as indicated therein. Thus, for example, when a nominal level of 100 parts per million compensation amorphous silicon composition is desired, that is amorphous silicon containing 100 parts per million of boron, and 100 parts per million of phosphorous, there is simultaneously introduced into the receptacle, silane gas containing about 90 parts per million of phosphine, and about 100 parts per million of diborane gas, while when a nominal compensation level of 10,000 parts per million is desired, there is introduced into the reaction receptacle silane gas, with 1 percent phosphine, and 1 percent of diborane gas. Generally, the process and apparatus useful for preparing the photoresponsive devices of the present invention containing the amorphous compensated silicon compositions disclosed herein, are disclosed in copending application U.S. Ser. No. 456,935, filed on Jan. 10, 1983, the disclosure of this application being totally incorporated herein by reference. Generally, the apparatus disclosed in the copending application, as is illustrated in FIG. 5 is comprised of a rotating cylindrical first electrode means 3, secured on an electrically insulating rotating shaft, radiant heating element 2 situated within the first electrode means 3, connecting wires 6, a hollow shaft rotatable vacuum feedthrough 4, a heating source 8, a hollow drum substrate 5, containing therein the first electrode means 3, the drum substrate being secured by end flanges, which are part of the first electrode means 3, a second hollow counterelectrode means 7, containing flanges thereon 9 and slits or vertical slots 10 and 11, receptacle or chamber means 15, containing as an integral part thereof receptacles 17 and 18 for flanges 9 for mounting the module in the chamber 15, a capacitive manometric vacuum sensor 23, a gauge 25, a vacuum pump 27, with a throttle valve 29, mass flow controls 31, a gauge and set point box 33, gas pressure vessels 34, 35, and 36, for example pressure vessel 34 containing silane gas, pressure vessel 35 containing phosphine gas, and 36 containing diborane gas, a current source means 37 for the first electrode means 3 and a second counter electrode means 7. The chamber 15 contains an entrance means 19 for the source gas material and an exhaust means 2 for the unused gas source material. Generally, in operation the chamber 15 is evacuated by vacuum pump 27 to appropriate low pressures. Subsequently, a silane gas, a phosphine gas, and a diborane gas, originating from vessels 34, 35 and 36 are simultaneously introduced into the chamber 15 through entrance means 19, the flow of the gases being controlled by the mass flow controller 31. These gases are introduced into the entrance 19 in a cross-flow direction, that is the gas flows in the direction perpendicular to the axis of the cylindrical substrate 15, contained on the first electrode means 3. Prior to the introduction of the gases, the first electrode means is caused to rotate by a motor and power is supplied to the radiant heating elements 2 by heating source 8, while voltage is applied to the first electrode means and the second counterelectrode means by a power source 37. Generally, sufficient power is applied from the heating source 8 that will maintain the drum 5 at a temperature ranging from about 100° C. to about 300° C. and preferably at a temperature of about 200° C. to 250° C. The pressure in the chamber 15 is automatically regulated so as to correspond to the settings specified at gauge 25 by the position of throttle valve 29. Electrical field created between the first electrode means 3 and the second counterelectrode means 7 causes the silane gas to be decomposed by glow discharge whereby amorphous silicon containing phosphorous and boron are deposited in a uniform thickness on the surface of the cylindrical means 5 contained on the first electrode means 3. There thus results on the substrate a compensated amorphous silicon composition.

The flow rates of the separate gases introduced into the reaction chamber depends on a number of variables including the desired level of compensation to achieved. Thus, for example, the amount of boro contained in the amorphous silicon on an atomic basis is about a factor of two-to-four more than the amount of boron which is calculated from the mixing ratio of the gases diborane and silane. The amount of phosphorous introduced is that amount which effectively electrically compensates the boron, the optimum amount being determined emperically by electrical device evaluation and print testing. Thus, it has been found that the flow rate of a phosphine gas has to be about 10 percent less than the flow rate of diborane gas to obtain the desired compensated photosensitive amorphous silicon composition described. Other reaction parameters and process conditions are as detailed in the copending application.

With specific regard to the preparation of the devices as illustrated in FIGS. 1, 2, 3 and 4, these devices can be prepared in the following manner.

The apparatus, as illustrated in FIG. 5, is evacuated by an appropriate vacuum pump and the mandrel and drum substrate are heated. The silane gas with the appropriate dopants, such as diborane gas and phosphine gas, are introduced through the mass flow controllers. Once the gas flow rate has become stationary, the pressure in the reaction chamber, that is, the pressure in the annular space between the drum substrate and the counterelectrode, is regulated by means of a throttle valve in the vacuum exhaust line. Once the pressure becomes stationary, voltage is applied to the mandrel containing the drum substrate and the counterelectrode. This voltage is of sufficient value so as to cause breakdown of the gas in the reaction chamber, which breakdown is usually accompanied by a visible glow. The condensable species, which are created by the process in the glow discharge, deposit on the drum substrate and the counterelectrode. During the process of deposition, the substrate temperature, the gas flow rates, the total gas pressure, and the applied voltages, or current, are maintained at a constant level by appropriate feedback loops. Compensated amorphous silicon films of, for example, 1 percent compensation level are fabricated by the introduction of 100 sccm of silane gas, premixed by the manufacturer, Union Carbide, with diborane gas, such that the mixture contains 1 percent of diborane, into the vacuum chamber. In addition 100 sccm of silane gas, available from Union Carbide, with phosphine, such that the mixture contains 1 percent of phosphine, is also introduced into the vacuum chamber. Subsequently, the vacuum pumps are throttled in order that the total pressure of the gas mixture in the vacuum chamber is 250 mTorr. A d.c. voltage of −1000 Volts is applied to the mandrel with the substrate electrode, and the counterelectrode is maintained at ground potential. The resulting current of about 100 milli-amperes is maintained at a constant level during the deposition process. After about three hours, a film of compensated amorphous silicon of a thickness of about 20 micrometers has deposited on the drum substrate. The voltage is then disconnected from the electrode and from the heater elements, the gas flow is terminated, and air is allowed into the vacuum system. Subsequently, the drum containing the compensated amorphous silicon is removed from the vacuum chamber apparatus. Other compensation levels can be obtained in a similar manner by adjusting the relative flow rates of the gases.

Photoresponsive devices containing overcoatings of silicon nitride, or silicon carbide are generally prepared by the glow discharge deposition of mixtures of silane and ammonia, or silane and nitrogen; and silane with a hydrocarbon gas, such as methane, using the apparatus of FIG. 5 for example, which overcoatings are deposited on the compensated amorphous silicon layer. Amorphous carbon is deposited as an overcoating in a similar manner with the exception that there is selected for the glow discharge apparatus a hydrocarbon gas, such as methane.

Also in an important embodiment of the present invention there is provided photoresponsive imaging devices as disclosed wherein the degree of compensation increases from zero percent compensation to one percent compensation, or a gradient increase, for a distance of from about 0.1 microns to about 5 microns which distance is measured from the uncompensated amorphous silicon layer to the compensated amorphous silicon layer.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

EXAMPLE I

An amorphous silicon photoreceptor was fabricated with the apparatus as illustrated in FIG. 5, and in accordance with the process conditions as illustrated in copending application U.S. Ser. No. 456,935. Thus, an aluminum drum substrate, 15.8 inches long, with an outer diameter of 3.3 inches, was inserted over a mandrel contained in the vacuum chamber of FIG. 5, and heated to 225° C. in a vacuum at a pressure of less than $10^{-4}$ Torr. The drum and mandrel were then rotated at 5 revolutions per minute and, subsequently, 200 sccm of silane gas doped with 8 parts per million of diborane gas was introduced into the vacuum chamber. The pressure was then maintained at 250 milliTorr, by an adjustable throttle valve. A d.c. voltage of −1,000 volts was then applied to the aluminum drum with respect to the electrically grounded counterelectrode, which electrode had an inner diameter of 4.8 inches, a gas inlet and exhaust slot of 0.5 inches wide, and was of a length of 16 inches.

When three hours had elapsed, the voltage to the mandrel was disconnected, the gas flow was terminated, and the drum sample was cooled to room temperature, followed by removal from the vacuum chamber. The thickness of the uncompensated photosensitive amorphous silicon contained on the aluminum drum was determined to be 20 microns, as measured by a Permascope. This photoconductor was then incorporated into the xerographic imaging apparatus, commercially available as the Xerox Corporation 3100, and images were generated at electric fields of 20 volts per micron as measured by an electrostatic surface voltage probe which was incorporated in the drum cavity. The images, subsequent to development with toner particles comprised of a styrene-n-butyl methacrylate copolymer, and carbon black particles, and transfer of this image to paper, were of poor quality as evidenced by numerous white spots, deletions, and areas of decreased resolution, and blurring subsequent to a few imaging cycles, as determined by visual observation. The density of the print defects increased rapidly with the number of imaging cycles.

The degree of loss of image resolution was determined to depend, for example, on the humidity, the age of the photoresponsive device, and the amount of abrasion during print testing. A remarkable improvement in imaging behavior was obtained when the device as prepared above was overcoated with compensated amorphous silicon. This was accomplished by depositing in the vacuum chamber, subsequent to deposition of the above uncompensated amorphous silicon transport layer, compensated amorphous silicon by simultaneously introducing into the vacuum chamber silane gas, doped with 5,000 parts per million of phosphorous, and 6,000 parts per million of diborane. The deposition was continued at a temperature of 225° C. for 30 minutes, while the aluminum drum voltage was maintained at −1,000 volts. Subsequent to removal of the resulting drum from the vacuum chamber, it was subjected to print testing at electric fields of 20 volts per micron. Images were then generated in the Xerox Corporation 3100® device and, subsequent to development with toner particles comprised of a styrene-n-butyl methacrylate copolymer containing carbon black particles, the images were of excellent quality, and did not degrade with cycling, up to at least 100,000 imaging cycles, at which time the test was terminated nor did the photoreceptor age, at relative humidities ranging from about 20 percent relative humidity to about 80 percent relative humidity.

EXAMPLE II

A homogeneous film, 20 microns in thickness of compensated amorphous silicon was deposited on an electroformed nickel substrate of a thickness of 4 mil. by repeating the procedure of Example I only as this procedure applies to the device containing compensated amorphous silicon. The temperature of the aluminum drum substrate was maintained at 230° C., a negative voltage of −1,000 volts was applied to this substrate, and the pressure was maintained at 1 Torr. A gas mixture was introduced into the vacuum chamber containing 500 sccm of hydrogen, and 50 sccm of silane gas doped with substantially equal amounts, that is 100 parts per million of diborane gas, and 90 parts per million of phosphine gas.

There results on the aluminum substrate a compensated amorphous silicon composition, with a nominal compensation level of 100 ppm, containing boron and phosphorous as evidenced by analytical measurements with secondary ion mass spectroscopy. This device was then electrically tested, followed by print testing. In the electrical testing procedure, there was generated a photo-induced discharge curve which was substantially identical to the discharge curve for uncompensated amorphous silicon films fabricated under the same reaction conditions.

Print testing in an imaging apparatus, commercially available as the Xerox Corporation 3100, was accomplished by incorporating the above compensated amorphous silicon device therein, and at electric fields of 20 volts per micron, there resulted subsequent to development, images of excellent resolution, no blurring, for 100,000 imaging cycles, over a relative humidity range of 20 percent relative humidity to 80 percent relative humidity.

EXAMPLE III

A photoresponsive device containing compensated amorphous silicon was prepared by repeating the procedure of Example II. Subsequent to completion of the deposition cycle, that is on completion of the deposition of compensated amorphous silicon on the aluminum drum, the voltage to the mandrel was disconnected and a gas mixture containing 30 sccm of silane gas, and 100 sccm of ammonia was introduced into the reaction chamber. A pressure of 250 m-Torr was maintained, and a voltage of −250 volts was applied to the drum substrate and the deposition process was continued for 5 minutes at which point the voltage to the drum was again disconnected. There thus results a silicon nitride layer, 0.3 microns in thickness, over the compensated amorphous silicon layer previously deposited.

Testing of the resulting device in the Xerox Corporation 3100® of Example II evidenced a residual voltage after photodischarge of 20 volts, as measured by an electrostatic probe. This residual voltage remained constant with electrical cycling for up to 20,000 cycles. Additionally, the electrical characteristics of this overcoated device, including the charge acceptance, about 500 volts, and the residual voltage, about 60 volts, caused by the silicon nitride top layer, after photodischarge, are not sensitive to humidities of from about 20 percent relative humidity to about 80 percent relative humidity, at fields exceeding 30 volts per micron. This was evidenced by the fact that the charge retention of the device measured 0.1 seconds after the exposure of the top surface to a positive corona atmosphere, remains unchanged during electrical device evaluation in an environmental test chamber, where the relative humidity during testing was changed between 20 and 80%. During these tests, no measurable effect was observed on the residual voltage after photodischarge.

Print testing of the resulting device was accomplished at 15 volts per micron, by repeating the procedure of Example II wherein the above prepared device was incorporated into a Xerox Corporation 3100® machine, and there resulted, subsequent to development, images of excellent resolution, no blurring, for 100,000 imaging cycles. In contrast a similar photoresponsive, that is the photoresponsive device of Example I, containing uncompensated amorphous silicon, overcoated with a silicon nitride layer, 0.3 microns in thickness when incorporated in the Xerox Corporation 3100 ® device resulted in blurred images begining with one copy cycle.

Additionally, the above-prepared compensated photoresponsive device was subjected to an abrasion test by vigorously rubbing the device with a pumicing compound, available from Xerox Corporation, and the resulting device was not affected in that the electrical characteristics of the device, including the charge acceptance and the residual voltage after photodischarge, were unchanged. Additionally, there was no noticable change in the xerographic print quality of the device prior to, or subsequent to the pumicing test.

EXAMPLE IV

An compensated overcoated photoresponsive device was prepared by repeating the procedure of Example I. Subsequently, a thin silicon nitride layer was deposited on top of the compensated amorphous silicon layer by repeating the part of the procedure of Example III pertaining to the nitride deposition. There thus resulted a device containing an uncompensated amorphous layer, a compensated amorphous silicon layer thereover, and a top coating of a silicon nitride layer.

Electrical testing was then accomplished on the resulting device by repeating the procedure of Example III, this testing occuring at 35 volts per micron, and there resulted for this device a residual voltage of 60 volts, as measured by an electrostatic probe, subsequent to photodischarge. This residual voltage remained relatively constant with cycling up to 20,000 cycles.

Print testing was then accomplished by repeating the procedure of Example I, with the Xerox Corporation 3100 ® copying apparatus, and there resulted, subsequent to development, images of excellent quality, with no blurring, as determined by visual observation. This print quality did not degrade for 100,000 imaging cycles, and remained constant over relative humidities of from 20 percent to 80 percent. In contrast a similar photoresponsive, that is the photoresponsive device of Example I, containing uncompensated amorphous silicon, overcoated with a silicon nitride layer, 0.3 microns in thickness when incorporated in the Xerox Corporation 3100 ® device resulted in blurred images begining with one copy cycle.

Additionally, the device was tested for abrasion by repeating the procedure of Example III and substantially similar results were obtained. Further, the device was scratch resistant, as determined by vigorous rubbing with grade 0 steel wool for five minutes. No visibly, or electrically observable deterioration could be observed subsequent to the abrasion test.

EXAMPLE V

A photoresponsive device was prepared by repeating the procedure of Example IV, with the exception that the discharge voltage was not disconnected when the gas mixture was modified from uncompensated amorphous silicon to compensated amorphous silicon. Thus, the gas mixture initially consisting of silane gas doped with 8 ppm diborane and no phosphine was linearly changed over a period of 30 minutes by adjusting the gas flow controllers, such that the gas at the end of this period consisted of silane doped with 6,000 ppm diborane and 5,000 ppm phosphine. The deposition of this mixture was continued for 15 more minutes at which point the voltage to the drum was discontinued. There thus results a compositional gradient between the uncompensated amorphous silicon and the compensated amorphous silicon, this gradient being from about zero percent compensation to 0.6 percent compensation for a distance of from about 0.1 microns to about 5 microns, which distance extends from the uncompensated amorphous silicon layer to the compensated amorphous silicon layer.

There resulted a photoresponsive device in accordance with Example IV with the exception that it contained a graded interface between the uncompensated amorphous silicon layer and the compensated amorphous silicon layer, as analytically determined by secondary ion mass spectroscopy, that is the layers were no longer sharply defined. Thus, the amount of compensated amorphous silicon in the two layers comprised of uncompensated amorphous silicon and compensated amorphous silicon increases from zero percent compensation to 0.6 percent compensation.

This device was then overcoated with a silicon nitride layer by repeating the procedure of Example III.

Electrical and print testing was then accomplished by repeating the procedure of Example III, and the residual voltage measured subsequent to photodischarge was 25 volts, this measurement being affected at the graded interface. This voltage remained constant for 20,000 imaging cycles.

Images obtained with the device, subsequent to its incorporation into a Xerox Corporation 3100 ® imaging apparatus, in accordance with the procedure of Example III, resulted in images of excellent resolution, no image blurring for 100,000 imaging cycles.

EXAMPLE VI

A photoresponsive device was prepared by repeating the procedure of Example II. Subsequently, there was directed into the reaction chamber 30 sccm of silane gas, doped with 1 percent of phosphine, and 100 sccm of ammonia gas. Discharge in the vacuum chamber was then continued for 5 minutes at a current density of 0.05 milliamps/cm$^2$. Subsequent to cooling, the device was removed from the vacuum chamber and was comprised of compensated amorphous silicon containing therein a 100 ppm level of compensation, which device was overcoated with a thin doped conductive silicon nitride layer.

The device was tested by repeating the procedure of Example III, at fields of 30 volts per micron, and substantially similar results were achieved in that the residual voltage, as measured with an electrostatic probe, was 10 volts. This voltage remained constant after 20,000 imaging cycles and over humidity conditions ranging from 20 percent relative humidity to 80 percent relative humidity.

Print testing was then accomplished at 25 volts per micron by repeating the procedure of Example III and, subsequent to development, images of excellent resolution were obtained and no degradation of the print quality was visually observed after 25,000 cycles.

The above prepared photoresponsive device was then tested for abrasion and scratch resistance by repeating the procedure of Example V, and substantially similar results were obtained.

Although the invention has been described with reference to specific preferred embodiments, it is not intended to be limited thereto. Rather, those skilled in the art will recognize variations and modifications may be made therein which are within the spirit of the invention and within the scope of the following claims.

We claim:

1. An electrophotographic photoresponsive device comprised of a supporting substrate, and an amorphous silicon composition containing in substantially equal amounts from about 25 parts per million by weight to about 1 weight percent of boron compensated with from about 25 parts per million by weight to about 1 weight percent of phosphorous.

2. An electrophotographic photoresponsive device in accordance with claim 1 wherein the supporting substrate is aluminum, stainless steel, electroformed nickel, or an insulating polymeric composition.

3. A photoresponsive device in accordance with claim 1 wherein the level of compensation is from about 25 parts per million by weight to about 1 percent, and the thickness of the amorphous silicon layer is from about 5 to about 40 microns.

4. An electrophotographic photoresponsive device comprised of a supporting substrate, a charge carrier transport layer comprised of uncompensated amorphous silicon, and a top overcoating layer comprised of amorphous silicon, containing in substantially equal amounts from about 25 parts per million by weight to about 1 percent weight of boron compensated with from about 25 parts per million by weight to about 1 percent of phosphorous.

5. An electrophotographic photoresponsive device in accordance with claim 4 wherein the supporting substrate is comprised of aluminum, stainless steel, electroformed nickel, or an insulating polymeric composition.

6. An electrophotographic photoresponsive device in accordance with claim 4 wherein the thickness of the uncompensated amorphous silicon layer is from about 5 to 40 microns, and the thickness of the compensated amorphous silicon layer is from about 0.5 microns to about 5 microns.

7. A photoresponsive device in accordance with claim 5 wherein the uncompensated amorphous silicon is doped with boron.

8. A photoresponsive device in accordance with claim 6 wherein the dopant boron is present in an amount of 4 parts per million by weight to 25 parts per million by weight.

9. An electrophotographic photoresponsive device comprised of a supporting substrate, and an amorphous silicon composition containing in substantially equal amounts from about 25 parts per million by weight to about 1 weight percent of boron compensated with from about 25 parts per million by weight to about 1 weight percent of phosphorous, and as an overcoating, silicon nitride, silicon carbide, or amorphous carbon; or wherein the photoresponsive device is comprised of a supporting substrate, an uncompensated amorphous silicon composition, a compensated amorphous silicon composition, containing from about 25 parts per million by weight to about 1 weight percent of boron compensated with from about 25 parts per million by weight to about 1 weight percent of phosphorous, and a top overcoating layer of silicon nitride, silicon carbide, or amorphous carbon.

10. A photoresponsive device in accordance with claim 9 wherein the supporting substrate is aluminum, stainless steel, electroformed nickel, or an insulating polymeric composition.

11. A photoresponsive device in accordance with claim 9 wherein the uncompensated amorphous silicon is doped with boron, or phosphorous.

12. A photoresponsive device in accordance with claim 9 wherein the silicon nitride, silicon carbide, or amorphous silicon top coating layer is of a thickness of from about 0.1 microns to about one microns, the uncompensated amorphous silicon layer is of a thickness of from about 5 microns to about 40 microns, and the compensated amorphous silicon layer is of a thickness of from about 0.5 micron to about 5 microns.

13. A photoresponsive device in accordance with claim 9 wherein the top layer of silicon nitride, or silicon carbide, is rendered partially conductive by the use of the non-stoichiometric composition $SiN_x$, or $SiC_y$, wherein x is a number from 1 to about 1.3, and y is a number from about 0.7 to about 1.3.

14. A photoresponsive device in accordance with claim 9 wherein the top overcoating layer of silicon nitride, silicon carbide, or amorphous carbon, is rendered conductive by doping this layer with from about 0.5 percent to about 5 percent by weight of phosphorous or boron.

15. A photoresponsive electrophotographic device comprised of a supporting substrate, a charge carrier transport layer comprised of uncompensated amorphous silicon, and a top overcoating layer comprised of amorphous silicon, containing in substantially equal amounts from about 25 parts per million by weight to about 1 percent weight of boron compensated with from about 25 parts per million to about 1 percent of phosphorous, wherein the compensation increases from zero percent compensation to one percent compensation, for a distance of from about 0.1 microns to about 5 microns, which distance extends from the uncompensated amorphous silicon layer to the compensated amorphous silicon layer.

16. A photoresponsive electrophotographic device comprised of a supporting substrate, and an amorphous silicon composition containing in substantially equal amounts from about 25 parts per million by weight to about 1 weight percent of boron compensated with from about 25 parts per million by weight to about 1 weight percent of phosphorous, wherein the compensation increases from zero percent compensation to one percent compensation, for a distance of from about 0.1 microns to about 5 microns, which distance extends from the uncompensated amorphous silicon layer to the compensated amorphous silicon layer and as an overcoating, silicon nitride, silicon carbide, or amorphous carbon; or wherein the photoresponsive device is comprised of a supporting substrate, an uncompensated amorphous silicon composition, a compensated amorphous silicon composition, containing in substantially equal amounts from about 25 parts per million by weight to about 1 weight percent of boron compensated with from about 25 parts per million by weight to about 1 weight percent of phosphorous, wherein the compensation increases from zero percent compensation to one percent compensation, for a distance of from about 0.1 microns to about 5 microns, which distance extends from the uncompensated amorphous silicon layer to the compensated amorphous silicon layer and a top overcoating layer of silicon nitride, silicon carbide, or amorphous carbon.

17. A method of imaging which comprises providing the photoresponsive device of claim 1, subjecting the device to imagewise exposure, developing the resulting image with toner particles, subsequently transferring the image to a suitable substrate, and optionally permanently affixing the image thereto, wherein there is obtained images of excellent quality and high resolution for over 1,000 imaging cycles.

18. A method of imaging which comprises providing the photoresponsive device of claim 4, subjecting the device to imagewise exposure, developing the resulting image with toner particles, subsequently transferring the image to a suitable substrate, and optionally permanently affixing the image thereto, wherein there is obtained images of excellent quality and high resolution for over 1,000 imaging cycles.

19. A method of imaging which comprises providing the photoresponsive device of claim 12, subjecting the device to imagewise exposure, developing the resulting image with toner particles, subsequently transferring the image to a suitable substrate, and optionally permanently affixing the image thereto, wherein there is obtained images of excellent quality and high resolution for over 1,000 imaging cycles.

20. A method of imaging which comprises providing the photoresponsive device of claim 15, subjecting the device to imagewise exposure, developing the resulting image with toner particles, subsequently transferring the image to a suitable substrate, and optionally permanently affixing the image thereto, wherein there is obtained images of excellent quality and high resolution for over 1,000 imaging cycles.

21. A method of imaging which comprises providing the photoresponsive device of claim 16, subjecting the device to imagewise exposure, developing the resulting image with toner particles, subsequently transferring the image to a suitable substrate, and optionally permanently affixing the image thereto, wherein there is obtained images of excellent quality and high resolution for over 1,000 imaging cycles.

22. An electrophotographic photoresponsive device comprised of a supporting substrate, and an amorphous silicon composition containing in substantially equal amounts from about 25 parts per million by weight to about 1 weight percent of boron compensated with from about 25 parts per million by weight to about 1 weight percent of nitrogen.

23. An electrophotographic photoresponsive device comprised of a supporting substrate, and an amorphous silicon composition containing in substantially equal amounts from about 25 parts per million by weight to about 1 weight percent of boron compensated with from about 25 parts per million by weight to about 1 weight percent of arsenic.

24. An electrophotographic photoresponsive device comprised of a supporting substrate, and an amorphous silicon composition containing in substantially equal amounts from about 25 parts per million by weight to about 1 weight percent of boron compensated with from about 25 parts per million by weight to about 1 weight percent of nitrogen, or arsenic, and as an overcoating, silicon nitride, silicon carbide, or amorphous carbon; or wherein the photoresponsive device is comprised of a supporting substrate, an uncompensated amorphous silicon composition, a compensated amorphous silicon composition, containing from about 25 parts per million by weight to about 1 weight percent of boron compensated with from about 25 parts per million by weight to about 1 weight percent of nitrogen, or arsenic, and a top overcoating layer of silicon nitride, silicon carbide, or amorphous carbon.

25. A photoresponsive electrophotographic device comprised of a supporting substrate, a charge carrier transport layer comprised of uncompensated amorphous silicon, and a top overcoating layer comprised of amorphous silicon, containing in substantially equal amounts from about 25 parts per million by weight to about 1 percent by weight of boron compensated with from about 25 parts per million to about 1 percent of nitrogen, or arsenic, wherein the compensation increases from zero percent compensation to one percent compensation, for a distance of from about 0.1 microns to about 5 microns, which distance extends from the uncompensated amorphous silicon layer to the compensated amorphous silicon layer.

26. A photoresponsive device comprised of a supporting substrate, and a photoconductive layer consisting essentially of hydrogenated amorphous silicon containing in substantially equal amounts from about 25 parts per million by weight to about 1 weight percent of boron compensated with from about 25 parts per million by weight to about 1 weight percent of phosphorous.

27. A photoresponsive device comprised of a supporting substrate; a charge carrier transport layer comprised of uncompensated hydrogenated amorphous silicon; and a top overcoating layer consisting essentially of hydrogenated amorphous silicon containing in substantially equal amounts from about 25 parts per million by weight to about 1 percent by weight of boron compensated with from about 25 parts per million by weight to about 1 weight percent of phosphorous.

28. A photoresponsive device in accordance with claim 9 wherein there is selected substantially hydrogenated amorphous silicon.

29. A photoresponsive device in accordance with claim 15 wherein there is selected substantially hydrogenated amorphous silicon.

30. A photoresponsive device in accordance with claim 16 wherein there is selected substantially hydrogenated amorphous silicon.

* * * * *